US005255498A

United States Patent [19]

Hotchkiss et al.

[11] Patent Number: 5,255,498

[45] Date of Patent: Oct. 26, 1993

[54] ENVELOPE STUFFING APPARATUS

[75] Inventors: Alan B. Hotchkiss, Westport; Shahzad H. Malick, Fairfield, both of Conn.

[73] Assignee: Pitney Bowes Inc., Stamford, Conn.

[21] Appl. No.: 608,515

[22] Filed: Nov. 2, 1990

[51] Int. Cl.[5] ..... B65B 39/12; B65B 43/34

[52] U.S. Cl. ..... 53/569; 53/258; 53/284.3; 53/381.5

[58] Field of Search ..... 53/569, 381.5, 381.7, 53/258, 260, 255, 468, 284.3

[56] References Cited

U.S. PATENT DOCUMENTS

| | | | |
|---|---|---|---|
| 3,936,993 | 2/1976 | Dorer | 53/569 X |
| 4,020,615 | 5/1977 | Irvine et al. | 53/284.3 |
| 4,205,506 | 6/1980 | Moens et al. | 53/569 |
| 4,753,429 | 6/1988 | Irvine et al. | 270/58 |
| 4,775,140 | 10/1988 | Foster | 271/121 |
| 4,903,456 | 2/1990 | Meur | 53/381.5 X |
| 4,926,612 | 5/1990 | Krasuski et al. | 53/381.5 X |

*Primary Examiner*—James F. Coan
*Attorney, Agent, or Firm*—Charles R. Malandra, Jr.; Melvin J. Scolnick

[57] ABSTRACT

In an envelope stuffing apparatus which has an enclosure inserting station and includes a deck, side guides mounted on the deck at the inserting station, structure for delivering the envelope in a path of travel to the inserting station, structure for opening the envelope, and structure inserting an enclosure into the envelope and for removing the envelope from the inserting station, and wherein said opening structure includes structure for supporting the flap of the envelope above the deck, there is an improvement in the envelope opening structure. The improvement comprises two throat openers insertable into the envelope for stripping apart from each other the front and back panels of the envelope. Each throat opener includes a side guide member for guiding the enclosure into the envelope and further including a ramp member for guiding the enclosure from the deck into the envelope.

27 Claims, 7 Drawing Sheets

ENVELOPE STUFFING APPARATUS

FIELD OF THE INVENTION

The present invention relates to an envelope stuffing apparatus, and more particularly as directed to a envelope stuffing apparatus on an inserter machine.

BACKGROUND OF THE INVENTION

Envelope stuffing machines, for example of the type shown in U.S. Pat. No. 2,736,999 issued Mar. 6, 1956 to F. J. Rouan, et al., U.S. Pat. No. 2,914,895 issued Dec. 1, 1959 to S. W. Martin, U.S. Pat. No. 4,077,181 issued Mar. 7, 1978 to L. K. Asher, et al., and U.S. Pat. No. 4,169,341 issued Oct. 2, 1979 to F. T. Roetter, et al., all of which patents are assigned to the assignee of the present invention, generally include: structure for 15 delivering an envelope, with its address panel oriented upwardly and its flap opened, to a registration gate at an enclosure inserting station; structure for timely opening the delivered envelope, including a plurality of fingers known in the art as stripper fingers, which are insertable into the throat of the envelope for opening the same; and structure for inserting an enclosure into the opened envelope. More particularly, the envelope opening structure of these devices includes a plate which acts as a ledge upon which the flap of the envelope is located when it is delivered to the inserting station. And, although none of the aforesaid patents show the same, the assignee of the present invention has for many years provided in its Model 3320 Table Top Inserter, one or more rigid finger members, known in the art as depressor fingers, which are fixedly attached to the framework of the Inserter and disposed in overhanging relationship with respect to the envelope's address panel, for depressing the body of the envelope's address panel downwardly against the resistance afforded by the envelope flap ledge, for partially opening the throat of the envelope to facilitate insertion of the stripper fingers into the envelope.

In U.S. Pat. No. 4,337,609 issued Jul. 6, 1982 to D. H. Foster, et al. and assigned to the assignee of the present invention, there is shown an envelope stuffing apparatus which includes a enclosure ram, a pair of outfeed push rollers and stripper fingers. The ram comprises a reciprocal ram plate having a depending portion which engages the enclosures. On the forward stroke of the ram plate, the plate carries therewith the enclosures into the throat of the opened envelope. As is well known in the art, the ram plate also moves the stuffed envelope downstream into feeding engagement with the outfeed rollers. Accordingly, the ram and outfeed rollers cooperate with each other for removing stuffed envelopes from the insert station.

The ram envelope stuffing apparatus of the above type has been successfully employed for many years. Although working well, there is a limitation on the throughput at the insertion station because of the reciprocating action of the ram plate. Typically, the ram insertion station operates well at a rate less than 6000 cycles (or envelopes per hour) for #10 (4 inch by 9 inch) envelopes. The rate of operation varies for different sized envelopes.

Improvements have been made recently in the throughput of the upstream modules of the inserter machine. An example of recent improvements is in the area of a dual accumulator described in U.S. Pat. No. 519,199 filed May 4, 1990, also assigned to the assignee of the present invention. However, the insert station employing the ram plate cannot take advantage of the improvements to the throughput of the upstream modules. This is, in part, due to the physical constraints associated with the ram mechanism, and, in part, to the motion inherent in the operating ram. Attempts at increasing the throughput of the ram type insert station has resulted in severe vibrations as the mass of the ram reciprocates at higher speeds. Such vibrations induce severe life shortage of the parts in the insert station. In addition, the reliability of the insert station decreases significantly at the higher speeds.

SUMMARY OF THE INVENTION

It has been found that replacing the ram mechanism with pusher fingers allows the insert station throughput speed to be increased without the problem inherent with increasing the speed of the RAM.

It has also been found that the reliability of achieving such an increased rate of insertion is furthered by replacing typical fingers or envelope throat openers with a throat opener which includes a side guide for preventing the enclosures from crashing into the side of the envelope.

In an envelope stuffing apparatus which has an enclosure inserting station and includes a deck and side guides mounted on the deck at the inserting station, and includes structure for delivering the envelope in a path of travel to the inserting station and includes structure for opening the envelope, and includes structure for inserting an enclosure into the envelope and for removing the envelope from the inserting station, and wherein the opening structure includes structure for supporting the flap of the envelope above the deck, there is an improvement in the envelope opening structure. The improvement comprises throat opener structure insertable into the envelope for stripping apart from each other the front and back panels of the envelope, the throat opener structure including a side guide member for guiding the enclosure into the envelope and further including a ramp member for guiding the enclosure from the deck into the envelope.

In accordance with another aspect of the invention wherein the delivery structure includes a first pusher operable at a first speed for advancing the enclosure towards the insert station, there is an improvement in the inserting structure. This improvement comprises second pusher operable at a second speed for overtaking the first pusher and advancing the enclosure to the insert station. The second speed is greater than the first speed, the second pusher is further operable for inserting the enclosure into the envelope.

In accordance with another aspect of the invention, the aforesaid improvements to the envelope opening structure and the inserting structure are combined.

BRIEF DESCRIPTION OF THE DRAWINGS

As shown in the drawings, wherein like reference numerals designate like or corresponding parts through the several views.

DETAILED DESCRIPTION OF THE PREFERRED EMBODIMENT

Figure 1:
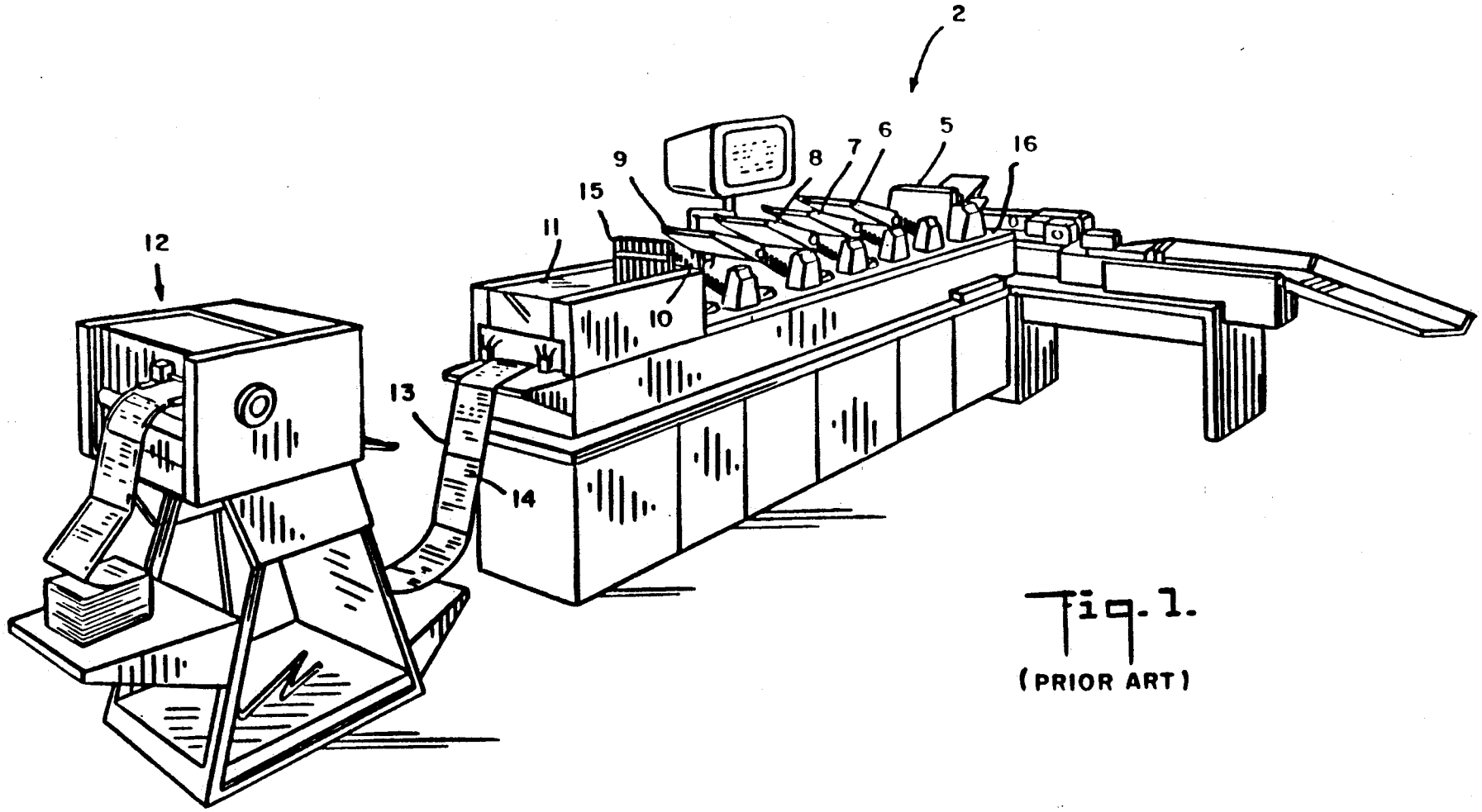
Fig. 1. (PRIOR ART)
FIG. 1 is a prior art console inserter machine in which the present invention may be employed.

In describing the preferred embodiment of the present invention, reference is made to FIG. 1 wherein there is seen a prior art console inserter generally designated 2 in which the present invention may be used.

The console inserter 2 includes a plurality of serially arranged modules including envelope feeder/insert station 5 and six document feeder stations, including five feeder stations designated 6, 7, 8, 9 and 10 and burster-folder station 11. A computer generated forms feeder 12 feeds continuous form control documents 13 having code marks 14 thereon to burster-folder 11 for separating and folding. The coded marks 14 on the control documents 13 are sensed by control scanner 15. Thereafter, serially arranged feeder stations 10, 9, 8, 7 and 6 sequentially feed the necessary documents onto the transport deck 16 at each station as the control document 13 arrives at the respective station to form a precisely collated stack of documents which is transported to the envelope feeder/insert station 5. Preferably, the transport deck 16 includes a ramp feed so that the control document always remains on top of the stack of advancing documents. The collated stack of documents is inserted into an envelope at envelope feeder/insert station 5. The necessary postage is provided and the envelope is sealed downstream from the envelope station.

Figure 2:
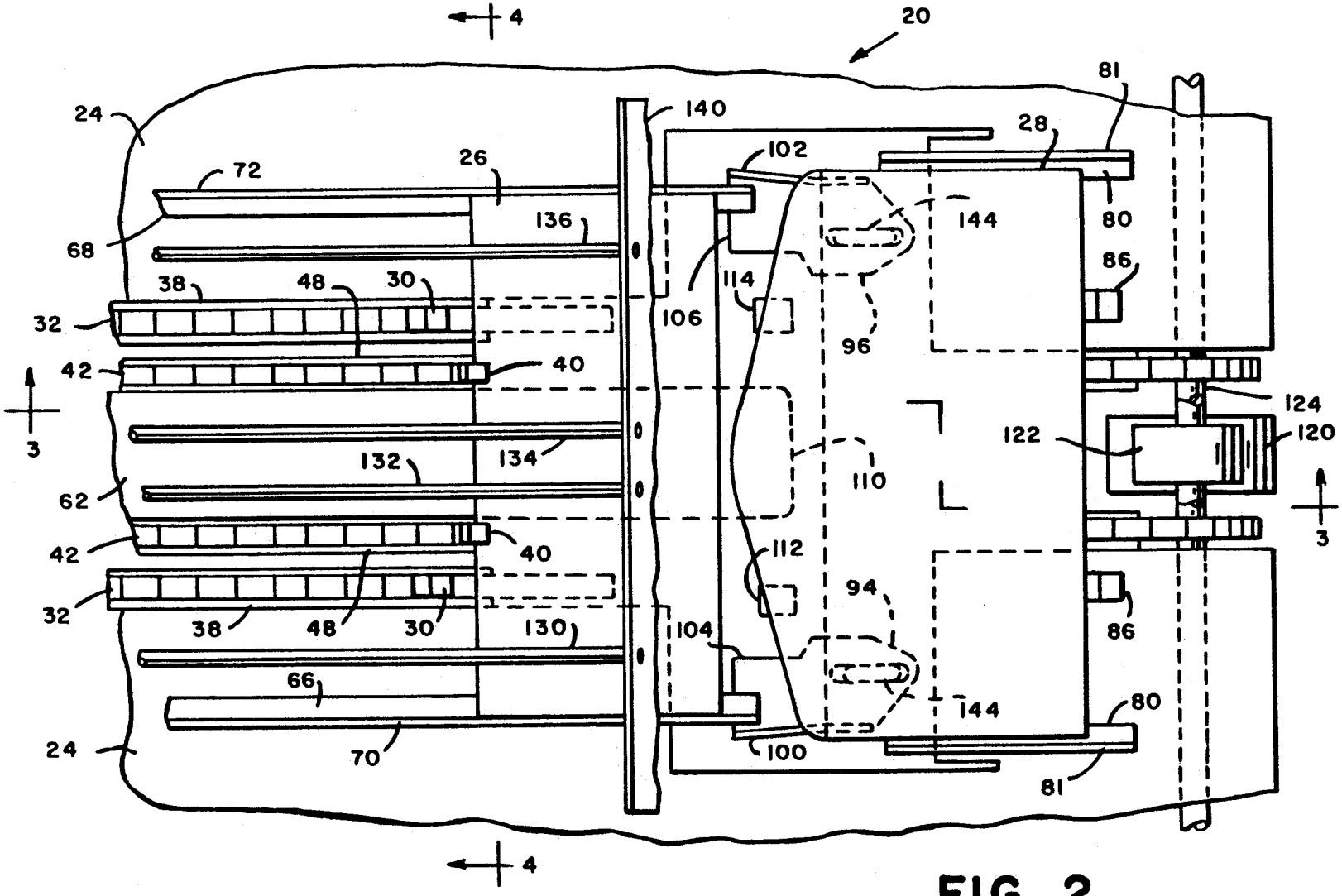
FIG. 2 is a top plan view of an envelope stuffing apparatus in accordance with the present invention.
Figure 3:
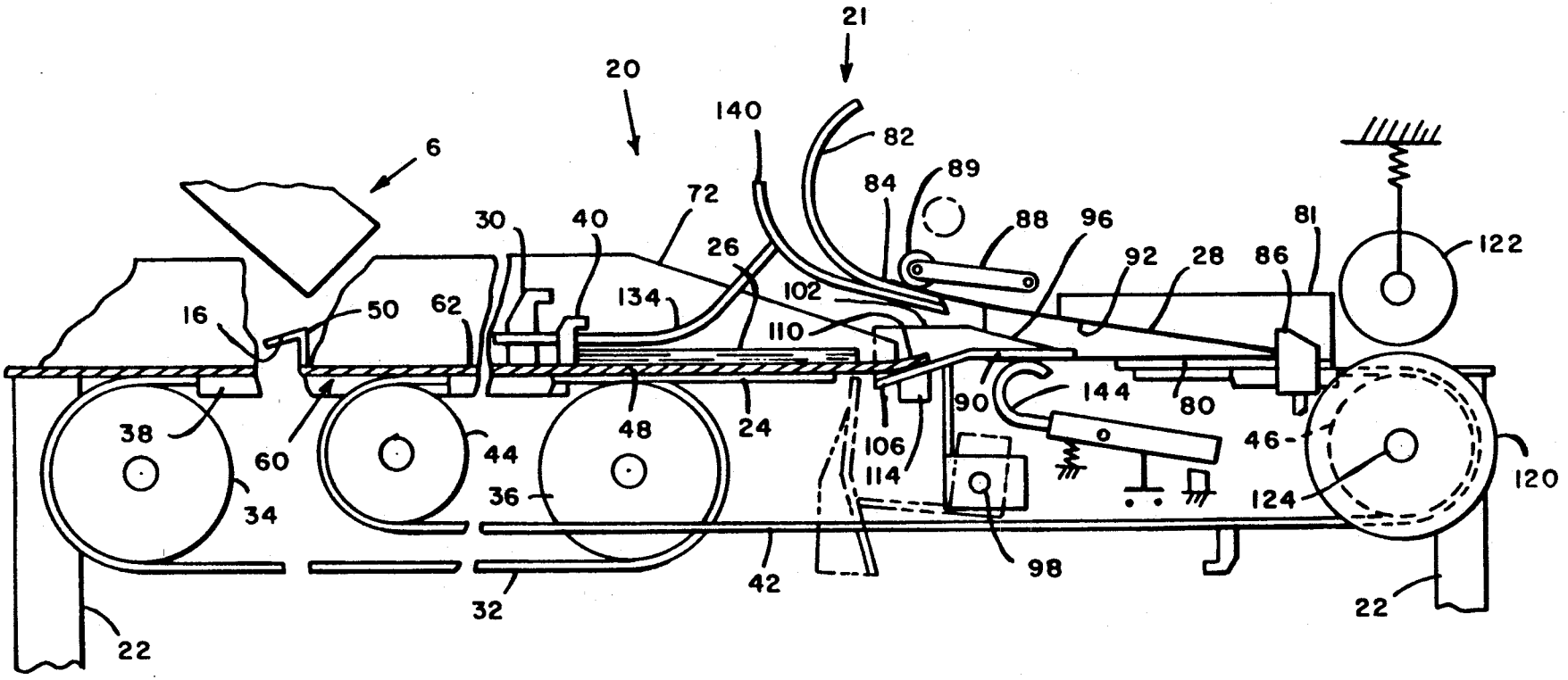
FIG. 3 is a side elevational view of the apparatus seen in FIG. 2, taken along the lines 3—3.
Figure 4:
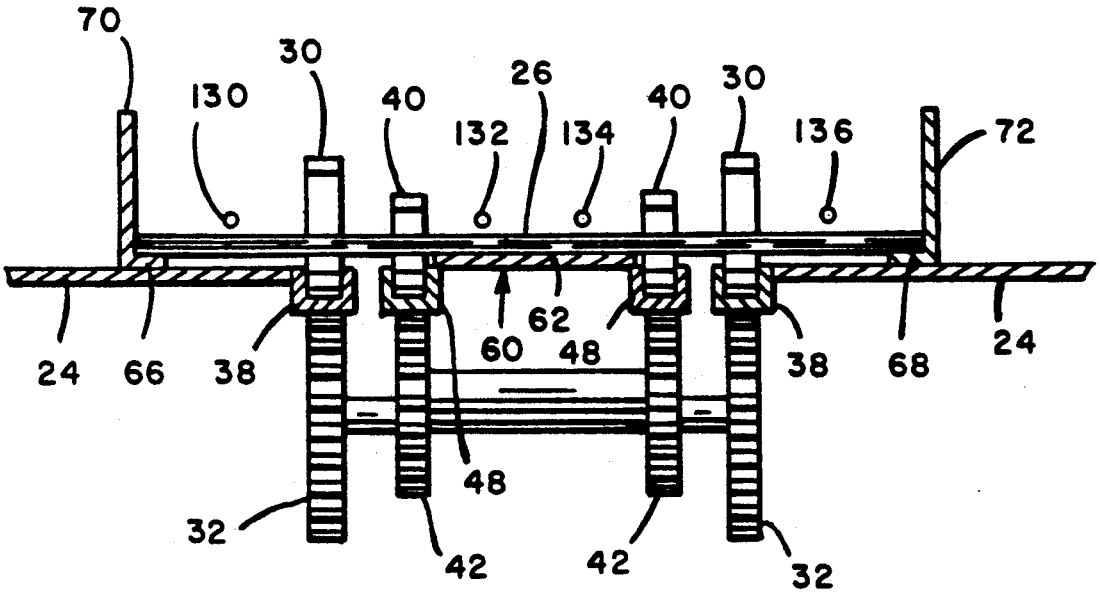
FIG. 4 is a front elevational view of the apparatus seen in FIG. 2, taken along the line 4—4.

Referring now to FIGS. 2, 3 and 4, there is an insert station 20 shown. The insert station comprises an envelope feeder 21 (shown only in part) and an envelope stuffing apparatus. The envelope stuffing apparatus comprises conventional framework 22 for supporting various components of the apparatus 20 including a deck support 24.

There are two pairs of pushers, each pair operating in parallel for delivering enclosure 26 to envelope 28. Each of the larger pair of pushers 30 is attached to one of a pair of endless chain drives 32 which are mounted on pairs of sprockets 34 and 36. Sprockets 34 are located upstream of the envelope stuffing apparatus. Sprockets 36 are located adjacent the insert area. The upper reach of each chain 32 is housed in a channel 38 for positioning and stabilizing the movement of pushers 30. In operation, pushers 30 transport enclosures 26 from the upstream feed stations of the inserter machine, for example, from the feeder 6 in FIG. 1, to the insert station 20 at a suitable speed, depending on the speed of the machine. For example, at 7200 cycles, the pushers 30 are moving 27 inches per second.

Downstream from the last enclosure feeder 6, a smaller pair of pushers 40 are each fixed to one of a pair of endless chain drives 42 each of which chain drives is mounted on sprockets 44 and 46. Sprockets 46 are the drive sprockets which are driven at a speed whereby pushers 40 have a linear speed, for example, of approximately one and one half (1.5) the linear speed of pushers 30. The upper reach of chains 42 are housed in channels 48 for positioning and stabilizing the movement of pushers 40.

Sprockets 44 are positioned adjacent the last enclosure feeder 6 and the change in deck level 16 at 50. Beginning at the deck level change 50, the enclosures are transported on a insert station deck 60 consisting of center deck plate 62, and the bottom members 66 and 68 of side guides 70 and 72.

The distance between longitudinally spaced pushers 40 on each chain drive 42 is a function of the distance between every two longitudinally spaced pushers 30 on chain driver 32 and the speed differential desired comparing the speed of pushers 40 to the speed of pushers 30. In the preferred embodiment of the present invention, the distance between longitudinally spaced pushers 30 is 27 inches. Therefore, for a desired speed differential of approximately 1.5, the distance between longitudinally spaced pushers 40 is 42 inches (or approximately 1.5 times 27 inches). In the preferred embodiment of the present invention, there are two pushers 40 on each of chain drives 42. In operation, the pushers 40 overtake pushers 30 in the delivery of the enclosures to the insert station shortly after pushers 30 transport the enclosures past deck level change 50. It will be understood that any suitable drive mechanism for pushers, for example, a belt drive, could also be used to drive pushers 40.

Envelopes 28 are fed from an envelope feeder 21 (shown in part) to envelope deck 80. In the preferred embodiment of the present invention, envelope deck 80 comprises two adjustable side guides 81 each with a bottom member acting as the deck 80. An example of an envelope feeder which can be used in conjunction with the present invention is described in U.S. Pat. No. 4,775,140 issued to Dean H. Foster on Oct 4, 1988 and assigned to the assignee of the present invention. There is ledge 82 on which the envelope flap 84 is supported during insertion of the enclosures. As the envelope is fed, a pair of stops 86 are used to stop and register the envelope 28. There are a plurality of depressor fingers 88, each including roller 89, which apply pressure to the envelope flap 84 during the insertion of the enclosures. The depressor fingers provide stability to the envelope during throat opening and insertion of enclosures. In the preferred embodiment of the present invention at least two fingers are used. When envelope 28 is fed, depressor fingers are in a raised position (shown in phantom).

There are a pair of throat openers 94 and 96 which open the envelope by separating the bottom side 90 of envelope 28 from the upper side 92. The throat openers 94 and 96 pivot about point 98 from a retracted position (shown in phantom in FIG. 3) below the deck to a position whereby the throat openers 94 and 96 become a continuation of deck 60 for guiding the enclosures into envelope 28. The throat openers 94 and 96 each include an outside, upright member which acts as a continuation of side guides 70 and 72 respectively, thereby preventing the enclosure from crashing into the side edges of envelope 28.

It has been found that pushers 40 and chain 42 arrangement provide a means for speeding up the insert process. This arrangement is an improvement over enclosure ram means such as described in U.S. Pat. No. 4,337,609 issued to Dean H. Foster, et al. in Jul. 6, 1982 and assigned to the assignee of the present invention. In such ram insert arrangements the ram plate typically includes a means for gripping the inserts whereby the registration and alignment of the inserts are maintained until the ram means is withdrawn from the envelope well after the enclosure insertion has been completed.

In the present invention, it has been discovered that adding side guide members 100 and 102 to throat openers 94 and 96 respectively prevents any skewing of the inserts or crashing of the inserts into the side edges of envelope 28.

The downstream end of side guides 70 and 72 overlap, respectively, with the upstream portion of throat openers 94 and 96 which are downwardly angled at 104 and 106 so that side guide 70 ends above the angled portion 104 and side guide 72 ends above angled portion 106. In this manner, throat openers 94 and 96 perform the dual task of opening envelope 28 and continuing the side guide into the envelope.

Throat openers 94 and 96 replace the typical fingers used for opening envelopes at an insert station. In addition to opening envelope 28, throat openers 94 and 96 act as side guides for the collation 26 and also act as ramps for avoiding a collision between the collation 26 and the side edges of envelope 28.

In the preferred embodiment of the present invention, the movement of stops 86, depressor fingers 88 and throat openers 94 and 96 is controlled respectively by three conventional cams on a shaft (not shown) under deck support 24. The cams are suitable for sequentially raising stops 86, lowering fingers 88 and raising throat openers 94 and 96 as envelope 28 is fed.

The downstream end or "lip" of center deck plate 62 is slightly angled upwardly at its downstream end 110. This serves to ensure that the center of the enclosures do not crash into the bottom side 90 of envelope 28. As enclosures 26 are about to be inserted into envelope 28, the outside edges of the enclosures, which are being transported on the bottom members 66 and 68 of side guides 70 and 72, are pushed onto throat openers 94 and 96, and the center of the enclosures is raised slightly to ensure that the enclosures do not hit the bottom side 90 of envelope 28. Because of the lip of deck plate 62, the center of the enclosures misses the bottom edge of envelope 28 and hits the lower side of flap 84. This greatly reduces the chance of a malinsertion in this area.

In the event the collation of enclosures 28 includes a less than full width document on the bottom, i.e., one that does not reach the bottom members 66 and 68 of side guides 70 and 72, then ramp members 112 and 114 are provided to prevent such smaller items in the collation from crashing into the bottom edge 90 of envelope 28. The top of ramp members 112 and 114 are angled less than 60 degrees upwardly in the downstream direction to raise the ends of such enclosures so that they miss the bottom side 90 of envelope 28.

It will be appreciated by those skilled in the art that the side guides 70, 72 and 81, depressor fingers 88 and throat openers 94 and 96 can be laterally positioned to handle different sized enclosures and envelopes.

There are a pair of takeaway rollers downstream from insert station. Driven roller 120 is mounted on drive shaft 124 on which is also mounted sprockets 46. Spring-loaded idler roller 122 operates in cooperation with driven roller 120 to yank the envelope 28 from pushers 40 before pushers 40 begin to follow the perimeter of sprockets 46. Roller 120 has a diameter larger than sprockets 46 such that the linear speed of the envelope in the grasp of rollers 120 and 122 is faster than the linear speed of pushers 40.

The speed differential between pushers 30 and 40 may cause enclosures 26 to rise off the deck as pushers 40 take over the advancement of enclosures 26. There are guide bars 130, 132, 134 and 136 which act to insure that the enclosures remain below the upper member lip of each pusher 40. The guide bars also act in conjunction with ledge 140 to ensure suitable clearance as the top of the enclosure stack enters the envelope 28. Guide bars 130, 132, 134 and 136 are suitably mounted upstream in a frame member (not shown) and downstream to ledge 140. Ledges 140 and 82 include two slot openings corresponding to the path of pushers 40 to ensure ledges 140 and 82 do not interfere with pushers 40.

There is a sensor switch 144 associated with each throat opener. The sensors operate to detect when an envelope is not present or has not been opened for insertion. There is a slot in each of throat openers 94 and 96 through which the hook in the respective sensor 144 fits through when an envelope has not been fed or has not been opened.

Referring now to FIGS. 5A–5F, one cycle of the insert station is described in detail.

Figure 5A:
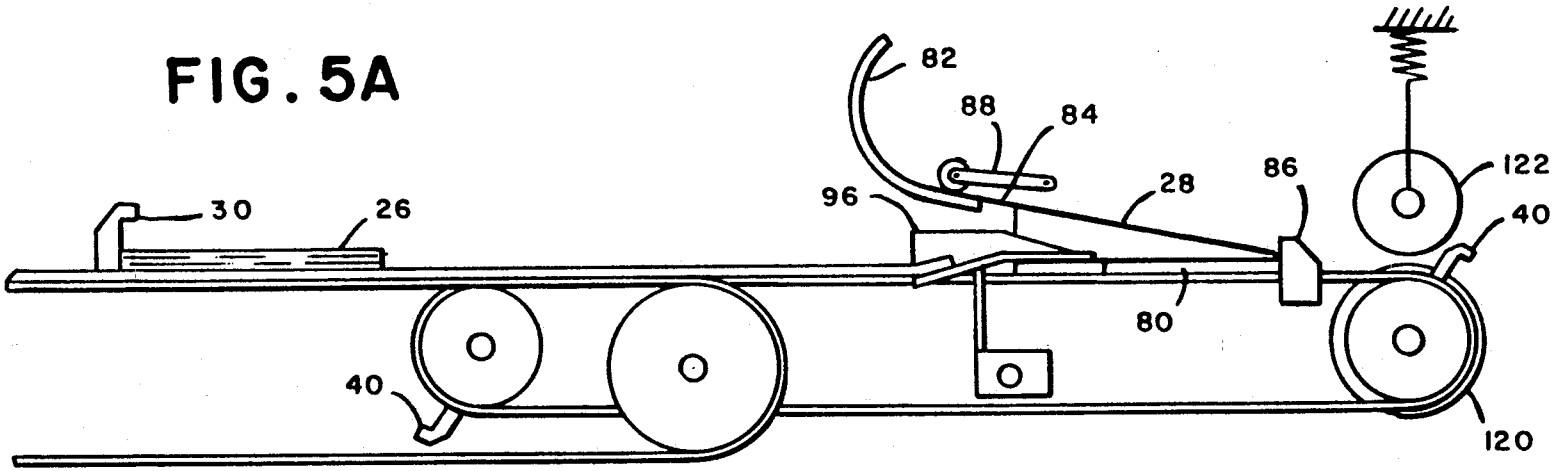
FIGS. 5A through 5F are stages in one cycle of the operation of the envelope stuffing apparatus seen in FIG. 3.

In FIG. 5A, the entire collation 26 is being pushed by pushers 30 towards the insertion area. At the same time, envelope 28 is fed down to envelope deck 80. Envelope stops 86 are in a raised position and depressor fingers 88 are in a down position for holding envelope flap 84. Throat openers 94 and 96 have pivoted up and have opened envelope 28. Envelope 28 is ready to receive collation 26.

Figure 5B:
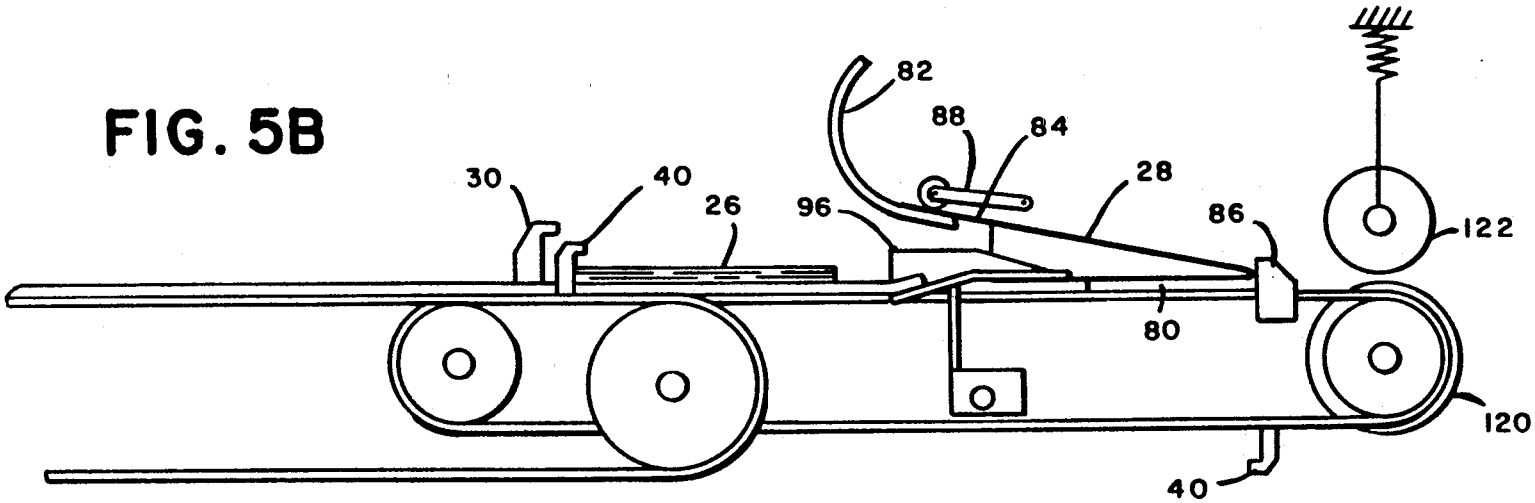

In FIG. 5B, pushers 40, which are travelling 1.5 times faster than pushers 30, take over the delivery of collation 26 from pushers 30 and move the collation away from pushers 30 before pushers 30 begin to go under the deck.

Figure 5C:
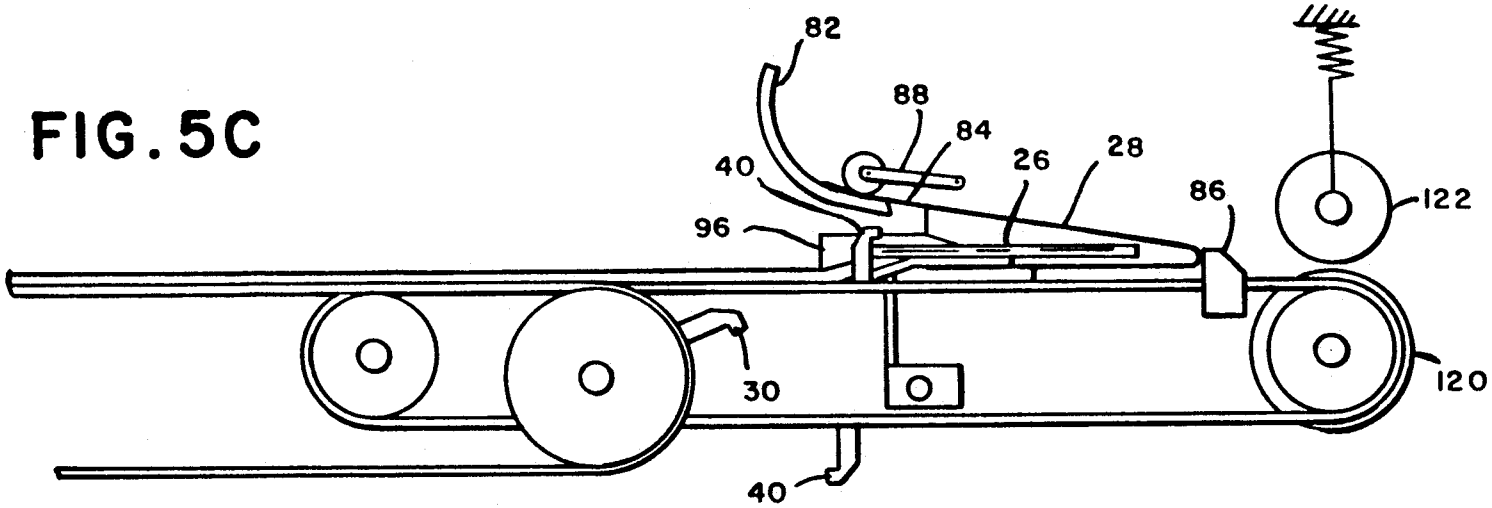

In FIG. 5C, pushers 30 are under the deck and pushers 40 are inserting the collation 26 into envelope 28. Stops 86 have begun to descend below deck 80, while throat openers 94 and 96 and depressor fingers 88 remain in their engaged positions.

Figure 5D:
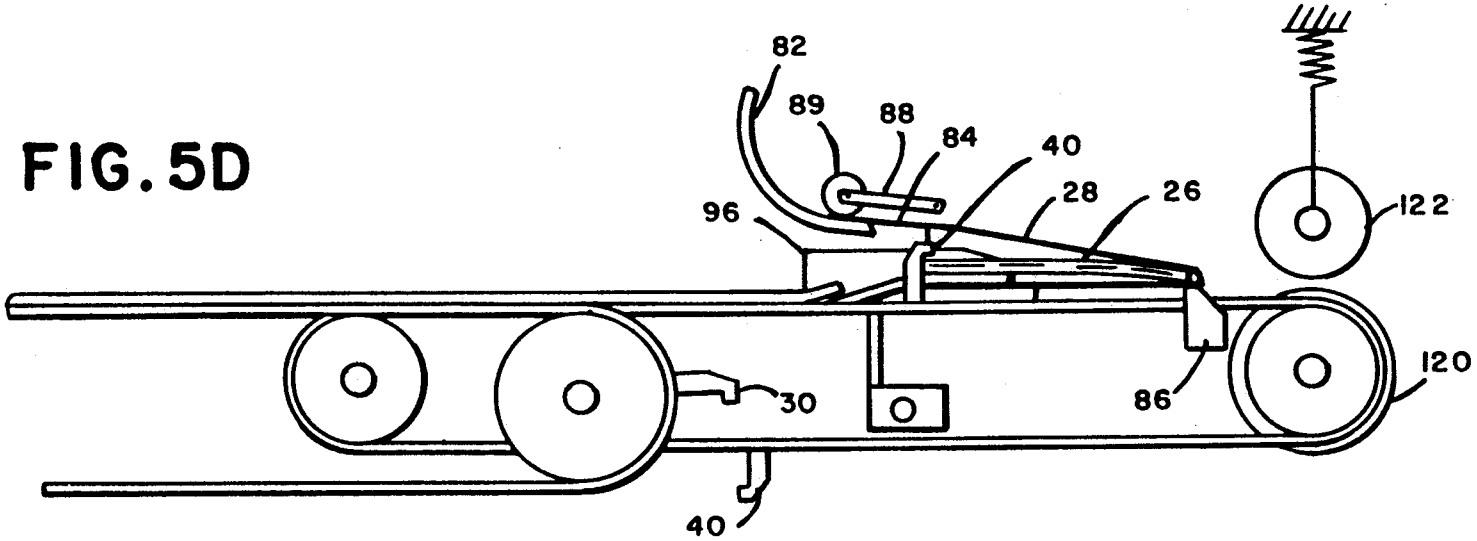

In FIG. 5D, stops 86 have just descended below deck 80 and collation 26 is completely in envelope 28. Pushers 40 have begun to advance the stuffed envelope towards takeaway rollers 120 and 122. Depressor fingers 88 continue to apply pressure on flap 84, but rollers 89 on the fingers 88 allow the pushers 40 to push the envelope flap out from under fingers 88. Fingers 88 apply pressure suitable to ensure the insertion is completed.

Figure 5E:
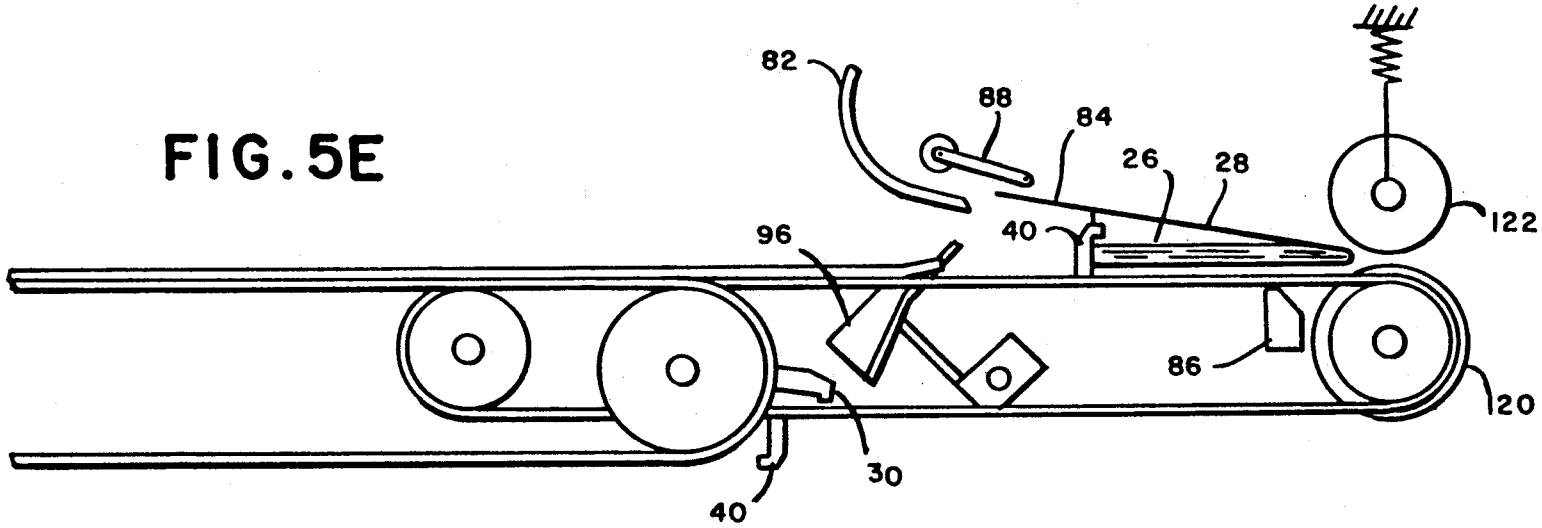

In FIG. 5E, the collation 26 has settled down into envelope 28 and the stops are completely down. Pushers 40 continue to push the stuffed envelope towards rollers 120 and 122. The throat openers 94 and 96 and fingers 88 are pivoting back to their disengaged position.

Figure 5F:
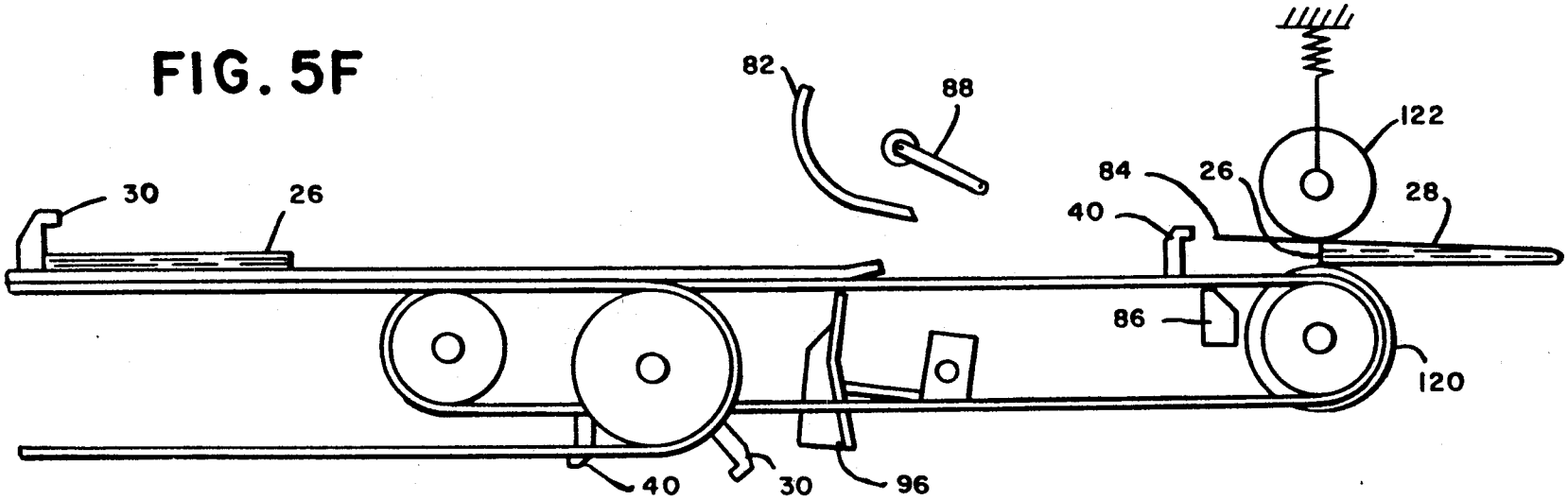

In FIG. 5F, the envelope is pushed into the bite of rollers 120 and 122. Since the radius of roller 120 is bigger than the radius of sprocket 46, the envelope is taken away before pushers 40 go under deck 80. One cycle is now complete.

It will be appreciated by those skilled in the art that there has now been described an improved envelope stuffing apparatus. Although this invention has been described in conjunction with a specific embodiment thereof, many alternatives, modifications and variations will be apparent to those skilled in the art. Accordingly, it is intended to embrace all such alternatives, modifications and variations that follow within the spirit and scope of the appended claims.

What is claimed is:

1. In an envelope stuffing apparatus which has an enclosure inserting station and includes a deck and side guides mounted on the deck at the inserting station, and includes means for delivering the envelope in a path of travel to the inserting station and includes means for opening the envelope, and includes means for inserting an enclosure into the envelope and for removing the envelope from the inserting station, and wherein said opening means includes means for supporting the flap of the envelope above the deck, an improvement in the envelope opening means, said improvement comprising:

throat opener means insertable into the envelope for stripping apart from each other the front and back panels of the envelope, said throat opener means including a side guide member for guiding the enclosure into the envelope and further including a ramp member for guiding the enclosure from the deck into the envelope.

2. The improvement according to claim-1, wherein said throat opener means includes two throat openers each having said side guide member and said ramp member, said throat opener being adjustably positioned on their respective side of the deck whereby the respective side guide member of each of said throat openers extend into said envelope when said throat openers are inserted into said envelope.

3. The improvement according to claim 2, wherein said throat opener means comprises sensor means for detecting an envelope misfeed or an unopened envelope.

4. The improvement according to claim 2, wherein said side guide member of each of said throat openers operates as a continuation of said side guides mounted on the deck when said throat opener is inserted in the envelope.

5. The improvement according to claim 2, wherein said ramp member of each of said throat openers operates as a continuation of the deck when said throat opener is inserted in the envelope.

6. The improvement according to claim 2, wherein when said throat openers are inserted in the envelope said side guide members of said throat openers operate as a continuation of said side guides mounted on the deck, and said ramp members of said throat openers operate as a continuation of the deck.

7. In an envelope stuffing apparatus which has an enclosure inserting station and includes a deck and side guides mounted on the deck at the inserting station, and includes means for delivering the envelope in a path of travel to the inserting station and includes means for opening the envelope, and includes means for inserting an enclosure into the envelope and for removing the envelope from the inserting station, and wherein said delivery means includes first pusher means operable at a first speed for advancing the enclosure towards the insert station, an improvement in the inserting means, said improvement comprising:

second pusher means operable at a second speed for overtaking the first pusher means and advancing the enclosure to the insert station, said second speed being greater than the first speed, said second pusher means being further operable for inserting the enclosure into the envelope.

8. The improvement according to claim 7, wherein said second pusher means pushes the envelope containing the inserted enclosures to take away means which remove the envelope from the insert station.

9. The improvement according to claim 7, wherein said second speed is 1.5 times the first speed.

10. The improvement according to claim 7, wherein said second pusher means include a pair of pushers mounted on separate chain drives.

11. The improvement according to claim 10, further comprising guide bar means positioned above the deck for preventing the enclosures from raising above the lip on each of said pushers.

12. The improvement according to claim 10, wherein said separate drives are chain drives.

13. The improvement according to claim 7, wherein said takeaway means are a pair of rollers.

14. In an envelope stuffing apparatus which has an enclosure inserting station and includes a deck and side guides mounted on the deck at the inserting station, and includes means for delivering the envelope in a path of travel to the inserting station and includes means for opening the envelope, and includes means for inserting an enclosure into the envelope and for removing the envelope from the inserting station, and wherein said opening means includes means for supporting the flap of the envelope above the deck, and said delivery means includes first pusher means operable at a first speed for advancing the enclosure towards the insert station, an improvement in the envelope opening means and the inserting means, said improvement comprising:

throat opener means insertable into the envelope for stripping apart from each other the front and back panels of the envelope, said throat opener means including a side guide member for guiding the enclosure into the envelope and further including a ramp member for guiding the enclosure from the deck into the envelope;

second pusher means operable at a second speed for overtaking the first pusher means and advancing the enclosure to the insert station, said second speed being greater than the first speed, said second pusher means being further operable for inserting the enclosure into the envelope.

15. The improvement according to claim 14, wherein said throat opener means includes two throat openers each having said side guide member and said ramp member, said throat opener being adjustably positioned on their respective side of the deck whereby the respective side guide member of each of said throat openers extend into said envelope when said throat openers are inserted into said envelope.

16. The improvement according to claim 15, wherein said throat opener means comprises sensor means for detecting an envelope misfeed or an unopened envelope.

17. The improvement according to claim 15, wherein said side guide member of each of said throat openers operates as a continuation of said side guides mounted on the deck when said throat opener is inserted in the envelope.

18. The improvement according to claim 15, wherein said ramp member of each of said throat openers operates as a continuation of the deck when said throat opener is inserted in the envelope.

19. The improvement according to claim 15, wherein when said throat openers are inserted in the envelope said side guide members of said throat openers operate as a continuation of said side guides mounted on the deck, and said ramp member of said throat openers operate as a continuation of the deck.

20. The improvement according to claim 15, wherein said second pusher means pushes the envelope containing the inserted enclosures to take away means which remove the envelope from the insert station.

21. The improvement according to claim 15, wherein said second speed is 1.5 times the first speed.

22. The improvement according to claim 15, wherein said second pusher means include a pair of pushers mounted on separate chain drives.

23. The improvement according to claim 22, further comprising guide bar means positioned above the deck for preventing the enclosures from raising above the lip on each of said pushers.

24. The improvement according to claim 15, further comprising ramp means for lifting the leading edge of the enclosure above the bottom side of the envelope as the enclosure is about to be inserted into the envelope.

25. In an envelope stuffing apparatus which has an enclosure inserting station and includes a deck and side guides mounted on the deck at the inserting station, and includes means for delivering the envelope in a path of travel to the inserting station and includes means for opening the envelope, and includes means for inserting an enclosure into the envelope and for removing the envelope from the inserting station, and wherein said opening means includes means for supporting the flap of the envelope above the deck, an improvement in the inserting means, the improvement comprising:

ramp means for lifting the leading edge of enclosure above the bottom side of the envelope as the enclosure is about to be inserted into the envelope.

26. The improvement according to claim 25, wherein said ramp means includes a ramped lip in the deck.

27. The improvement according to claim 25, wherein said ramp means includes at least two ramp members positioned at intermediary locations between deck portions.

* * * * *